US011409231B2

(12) United States Patent
Sato et al.

(10) Patent No.: US 11,409,231 B2
(45) Date of Patent: Aug. 9, 2022

(54) IMAGE FORMING APPARATUS HAVING A DRAWER INCLUDING A LOCK PORTION

(71) Applicant: BROTHER KOGYO KABUSHIKI KAISHA, Nagoya (JP)

(72) Inventors: Shougo Sato, Seto (JP); Kazuna Taguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/399,127

(22) Filed: Aug. 11, 2021

(65) Prior Publication Data

US 2021/0373487 A1 Dec. 2, 2021

Related U.S. Application Data

(63) Continuation of application No. 17/002,100, filed on Aug. 25, 2020, now Pat. No. 11,126,136.

(30) Foreign Application Priority Data

Sep. 2, 2019 (JP) ..... JP2019-159901

(51) Int. Cl.
*G03G 15/00* (2006.01)
*G03G 21/16* (2006.01)

(52) U.S. Cl.
CPC ..... *G03G 21/1647* (2013.01); *G03G 21/1633* (2013.01); *G03G 2221/1654* (2013.01)

(58) Field of Classification Search
CPC ..... G03G 21/16; G03G 21/1623; G03G 21/1633; G03G 21/1671; G03G 21/1676; G03G 21/1842; G03G 2221/1654
USPC ..... 399/110
See application file for complete search history.

(56) References Cited

U.S. PATENT DOCUMENTS

| | | | |
|---|---|---|---|
| 7,647,003 | B2 | 1/2010 | Itabashi |
| 8,452,208 | B2 | 5/2013 | Kikuchi |
| 11,126,136 | B2 * | 9/2021 | Sato et al. ..... G03G 21/1633 |
| 2016/0154341 | A1 | 6/2016 | Hamada et al. |
| 2021/0063935 | A1 | 3/2021 | Taguchi et al. |

FOREIGN PATENT DOCUMENTS

| | | |
|---|---|---|
| JP | 2016-110097 A | 6/2016 |

* cited by examiner

*Primary Examiner* — William J Royer
(74) *Attorney, Agent, or Firm* — Merchant & Gould P.C.

(57) ABSTRACT

An image forming apparatus includes: a drawer movable in a first direction from an inside position to an outside position via an intermediate position; a stopper movable between a first position at which the stopper stops the drawer from moving from the intermediate position to the outside position, and a second position at which the stopper allows the drawer to move from the intermediate position to the outside position; a drum cartridge including a photoconductive drum and mountable on the drawer; and a developing cartridge including a developing roller and mountable on the drawer. The developing cartridge mounted on the drawer is removable from the drawer in a state in which the drawer is located at the intermediate position. The drum cartridge mounted on the drawer is removable from the drawer in a state in which the drawer is located at the outside position.

12 Claims, 12 Drawing Sheets

IMAGE FORMING APPARATUS HAVING A DRAWER INCLUDING A LOCK PORTION

CROSS REFERENCE TO RELATED APPLICATION

The present application is a Continuation of U.S. patent application Ser. No. 17/002,100, filed Aug. 25, 2020, which claims priority from Japanese Patent Application No. 2019-159901, which was filed on Sep. 2, 2019, the disclosures of which are herein incorporated by reference in their entirety.

BACKGROUND

The following disclosure relates to an image forming apparatus.

There has been known an image forming apparatus including a housing, a drawer, and a process cartridge. The drawer is movable between an inside position at which the drawer is located inside the housing, and an outside position at which the drawer is located outside the housing. The process cartridge is mountable on the drawer. The process cartridge includes a photoconductive drum and a developing roller and is capable of storing toner.

SUMMARY

In the above-described image forming apparatus, the process cartridge includes the photoconductive drum and the developing roller.

Thus, for example, in the case where a remaining amount of the toner stored in the process cartridge is small, the entire process cartridge including the photoconductive drum needs to be replaced even if there is no need to replace the photoconductive drum. This makes it difficult to reduce cost.

Accordingly, an aspect of the disclosure relates to an image forming apparatus including a drawer and allowing individual replacement of a drum cartridge including a photoconductive drum and a developing cartridge including a developing roller.

In one aspect of the disclosure, an image forming apparatus includes: a housing; a drawer movable in a first direction from an inside position at which the drawer is located inside the housing, to an outside position at which the drawer is located outside the housing, via an intermediate position; a stopper movable between (i) a first position at which the stopper stops the drawer from moving from the intermediate position to the outside position, and (ii) a second position at which the stopper allows the drawer to move from the intermediate position to the outside position; a drum cartridge including a photoconductive drum and mountable on the drawer; and a developing cartridge including a developing roller and mountable on the drawer. The developing cartridge mounted on the drawer is removable from the drawer in a state in which the drawer is located at the intermediate position. The drum cartridge mounted on the drawer is removable from the drawer in a state in which the drawer is located at the outside position.

In another aspect of the disclosure, an image forming apparatus includes: a housing; a drawer movable in a first direction from an inside position at which the drawer is located inside the housing, to an outside position at which the drawer is located outside the housing, via an intermediate position; a stopper movable between (i) a first position at which the stopper stops the drawer from moving in the first direction by contacting the drawer located at the intermediate position, and (ii) a second position at which the stopper allows the drawer to move from the inside position to the outside position; a drum cartridge including a photoconductive drum and mountable on the drawer; and a developing cartridge including a developing roller and mountable on the drawer. The drawer includes: a first lock lever movable between (i) a lock position at which the first lock lever locks the developing cartridge to the drawer, and (ii) a lock release position at which lock of the developing cartridge to the drawer is released; and a second lock lever movable between (i) a lock position at which the second lock lever locks the drum cartridge to the drawer, and (ii) a lock release position at which lock of the drum cartridge to the drawer is released. The first lock lever is located outside the housing, and the second lock lever is located inside the housing in a state in which the drawer is located at the intermediate position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure.

1. Image Forming Apparatus 1

An image forming apparatus 1 according to one embodiment will be described with reference to FIGS. 1-3.

Figure 1:
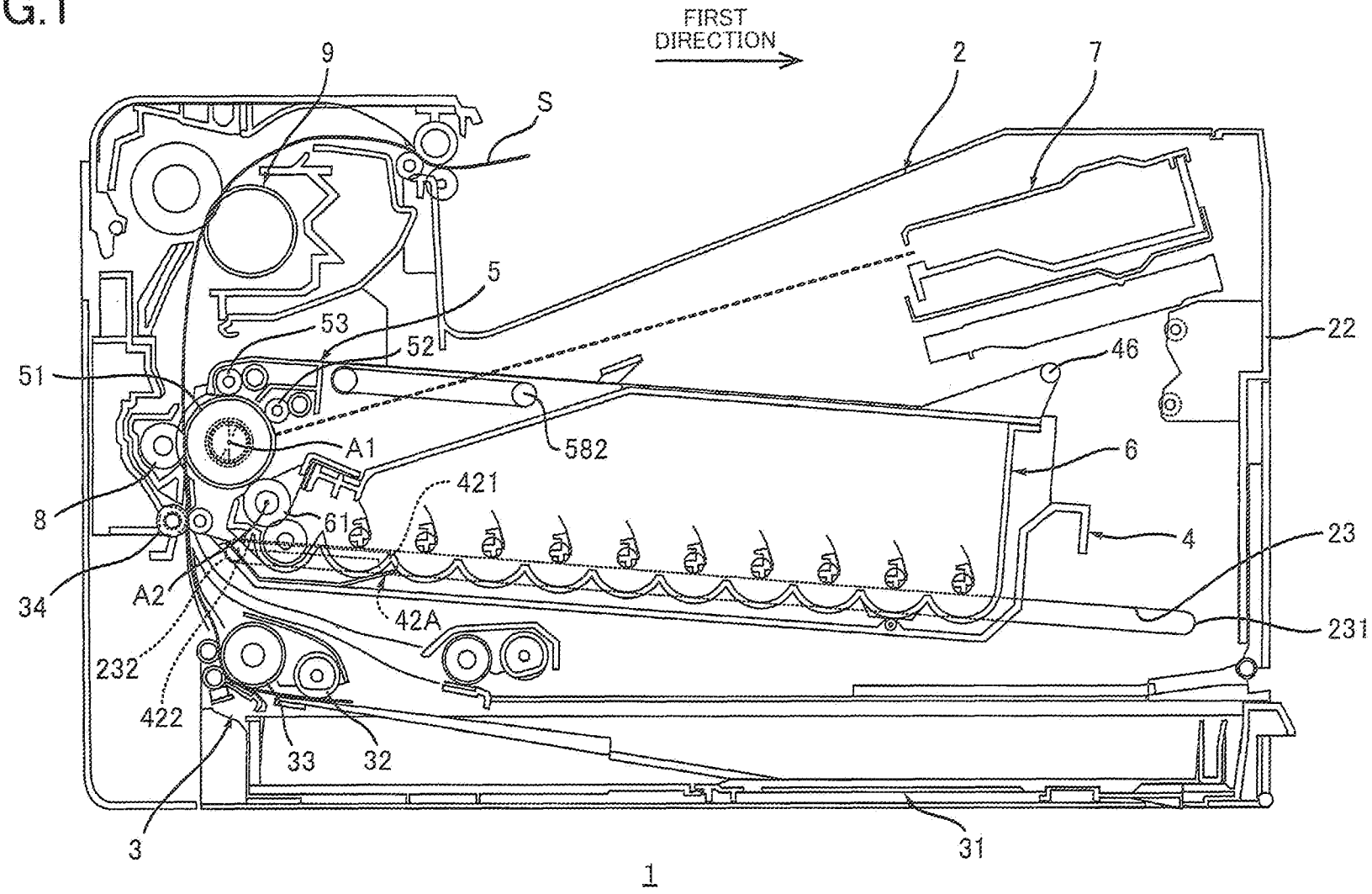
FIG. 1 is a cross-sectional view of an image forming apparatus according to a first embodiment.

As illustrated in FIG. 1, the image forming apparatus 1 includes a housing 2, a sheet supplier 3, a drawer 4, a drum cartridge 5, a developing cartridge 6, an exposing device 7, a transfer roller 8, and a fixing device 9. It is noted that the image forming apparatus 1 is specifically for monochrome printing. Thus, the image forming apparatus 1 includes one drum cartridge 5 and one developing cartridge 6.

1.1. Housing 2

The housing 2 houses the sheet supplier 3, the drawer 4, the drum cartridge 5, the developing cartridge 6, the exposing device 7, the transfer roller 8, and the fixing device 9. As illustrated in FIG. 2, the housing 2 has an opening 21. The housing 2 includes a cover 22.

Figure 2:
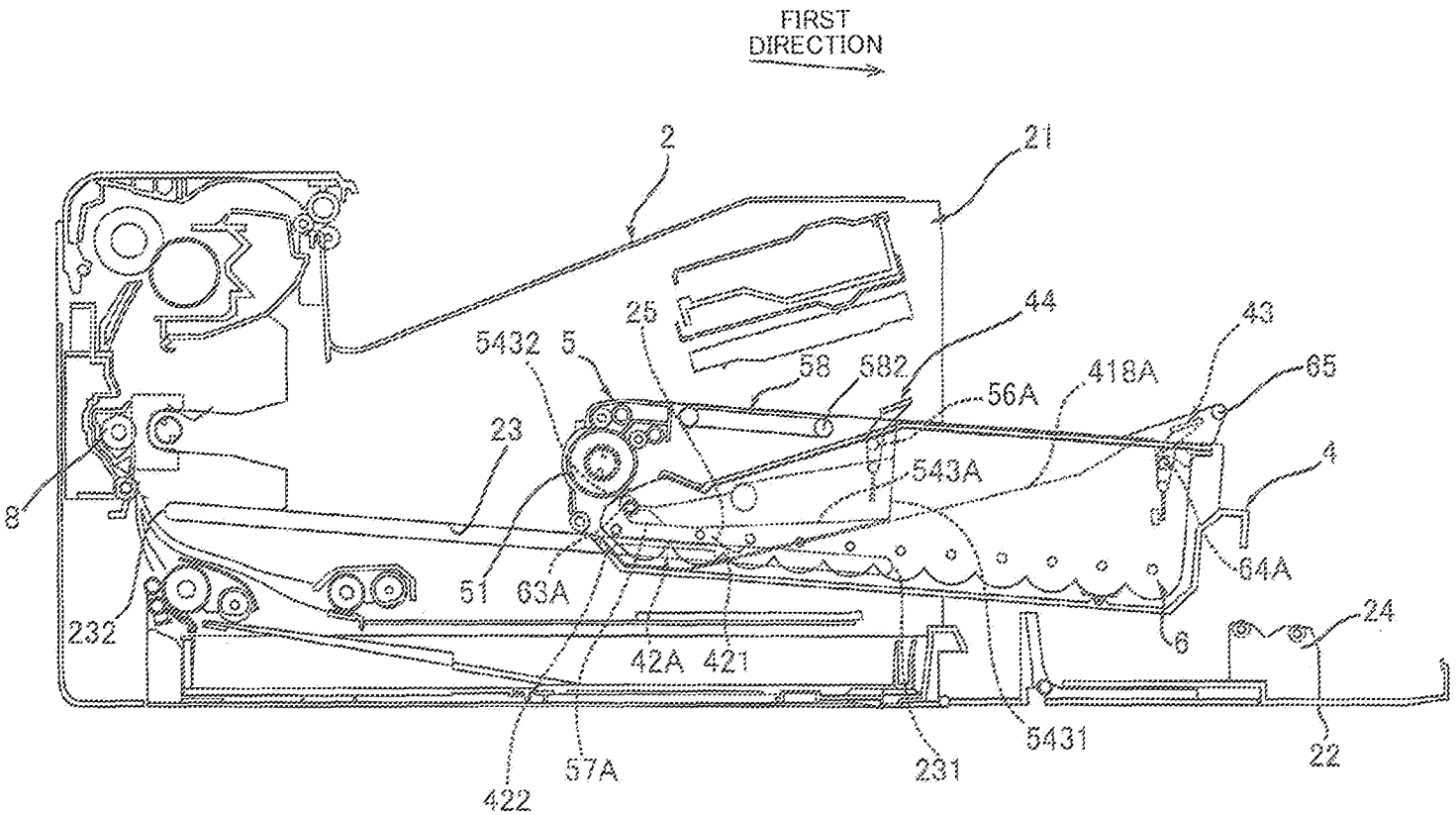
FIG. 2 is a cross-sectional view of the image forming apparatus, illustrating a state in which a drawer is located at an intermediate position.

The cover 22 is movable between a closed position (see FIG. 1) and an open position (see FIG. 2). When the cover 22 is located at the closed position, the cover 22 closes the opening 21. When the cover 22 is located at the open position, the opening 21 is open.

1.2. Sheet Supplier 3

As illustrated in FIG. 1, the sheet supplier 3 is capable of supplying a sheet S to a photoconductive drum 51. The photoconductive drum 51 will be described later. The sheet supplier 3 includes a sheet cassette 31, a pickup roller 32, a conveying roller 33, and a conveying roller 34.

The sheet cassette 31 accommodates the sheets S. The pickup roller 32 picks up an uppermost one of the sheets S in the sheet cassette 31. The pickup roller 32 conveys the picked-up sheet S toward the conveying roller 33. The conveying roller 33 conveys the sheet S supplied from the pickup roller 32, toward the conveying roller 34. The conveying roller 34 conveys the sheet S conveyed from the conveying roller 33, toward the photoconductive drum 51.

1.3. Drawer 4

Figure 3:
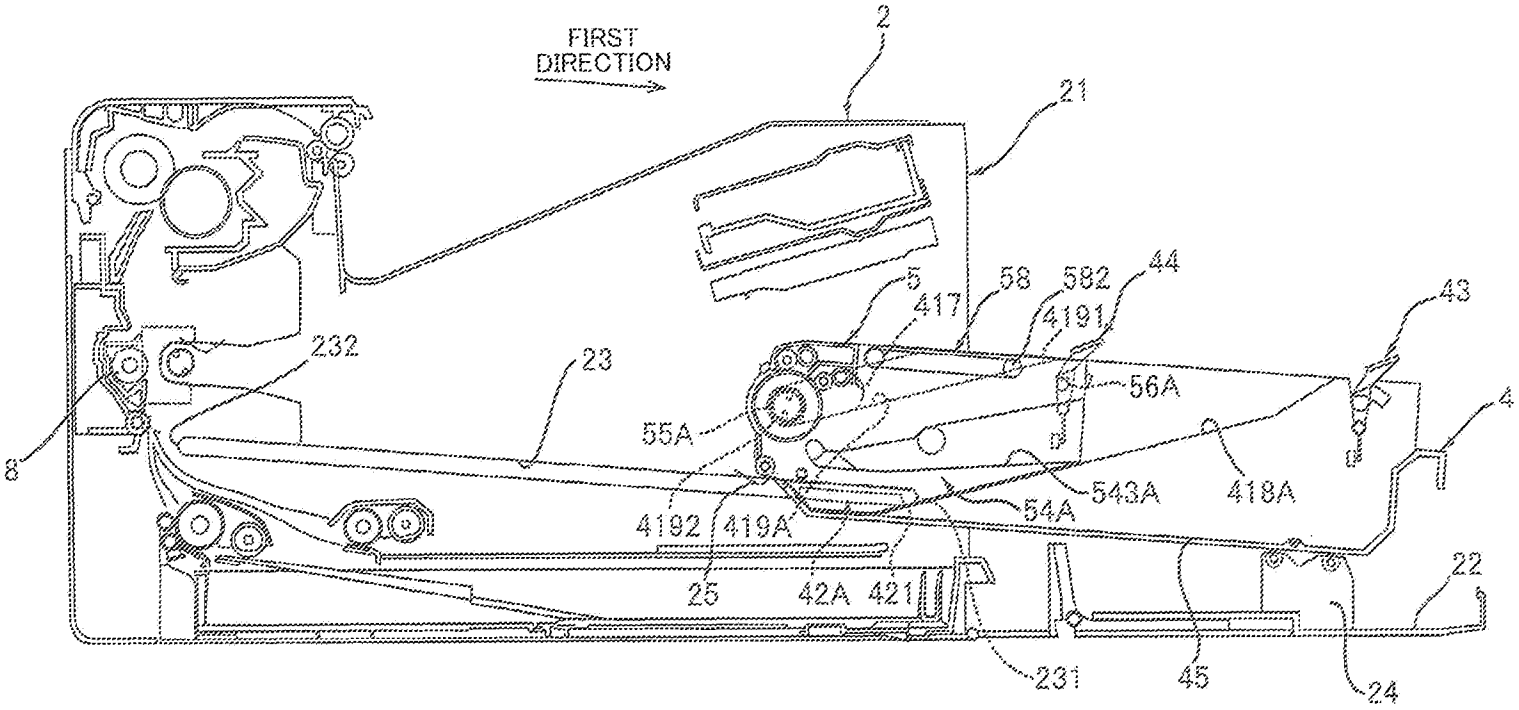
FIG. 3 is a cross-sectional view of the image forming apparatus, illustrating a state in which a developing cartridge is removed from the drawer, and the drawer is located at an outside position.

When the cover 22 is located at the open position, as illustrated in FIGS. 2 and 3, the drawer 4 is movable in a first direction from an inside position (see FIG. 1) to an outside position (see FIG. 3) via an intermediate position (see FIG. 2) through the opening 21. The first direction intersects the up and down direction. The drum cartridge 5 and the developing cartridge 6 are placeable on the drawer 4. The drawer 4 is movable in a state in which the drum cartridge 5 and the developing cartridge 6 are placed on the drawer 4.

Specifically, as illustrated in FIG. 3, the housing 2 includes a drawer guide 23 and a drawer support 24. The drawer guide 23 guides the drawer 4. The drawer guide 23 extends in the first direction. The drawer guide 23 is a groove. It is noted that the drawer guide 23 may be a rib. The drawer guide 23 includes a first end portion 231 and a second end portion 232. The first end portion 231 is located apart from the second end portion 232 in the first direction. The second end portion 232 is located between the first end portion 231 and the transfer roller 8 in the first direction. The drawer guide 23 is inclined such that the first end portion 231 is lower than the second end portion 232. The inclination of the drawer guide 23 causes the drawer 4 to move such that its position is lower at the outside position than at the inside position. This enables the drawer 4 to be easily moved from the inside position to the outside position using the weight of the drawer 4.

As illustrated in FIG. 1, a position of the drawer 4 at which a second guided portion 422 is fitted to the second end portion 232 of the drawer guide 23 is the inside position. The second guided portion 422 will be described later. The entire drawer 4 is located inside the housing 2 in a state in which the drawer 4 is located at the inside position.

As illustrated in FIG. 2, a position of the drawer 4 at which a first guided portion 421 is in contact with a stopper 25, and the drawer 4 is stopped between the inside position and the outside position is the intermediate position. The stopper 25 and the first guided portion 421 will be described later.

As illustrated in FIG. 3, a position of the drawer 4 at which the first guided portion 421 of the drawer 4 is fitted to the first end portion 231 of the drawer guide 23 is the outside position. At least a portion of the drawer 4 is located outside the housing 2 in a state in which the drawer 4 is located at the outside position.

The drawer support 24 is provided on the cover 22. The drawer support 24 supports the drawer 4 in a state in which the cover 22 is located at the open position, and the drawer 4 is located at the outside position. The drawer support 24 is in contact with a bottom plate 45 of the drawer 4 in the state in which the cover 22 is located at the open position, and the drawer 4 is located at the outside position. The bottom plate 45 will be described later.

1.4. Drum Cartridge 5

The drum cartridge 5 mounted on the drawer 4 is removable from the drawer 4 in the state in which the drawer 4 is located at the outside position. The state in which the drum cartridge 5 is mounted on the drawer 4 is a state in which the drum cartridge 5 is placed on a particular position of the drawer 4. The drum cartridge 5 may not be fixed to the drawer 4 in the state in which the drum cartridge 5 is mounted on the drawer 4. It is noted that the drum cartridge 5 is mountable on the drawer 4 in the state in which the drawer 4 is located at the outside position.

As illustrated in FIGS. 1 and 2, the drum cartridge 5 mounted on the drawer 4 is not removable from the drawer 4 in a state in which the drawer 4 is located at the inside position or the intermediate position. The drum cartridge 5 is not mountable on the drawer 4 in the state in which the drawer 4 is located at the inside position or the intermediate position.

As illustrated in FIG. 1, the drum cartridge 5 includes the photoconductive drum 51, a charging roller 52, and a cleaning roller 53.

1.4.1. Photoconductive Drum 51

The photoconductive drum 51 is rotatable about an axis A1. The axis A1 extends in a second direction. The second direction intersects the first direction and the up and down direction. The second direction is preferably orthogonal to the first direction and the up and down direction. The photoconductive drum 51 extends in the second direction. The photoconductive drum 51 has a cylindrical shape.

1.4.2. Charging Roller 52

The charging roller 52 is capable of charging a surface of the photoconductive drum 51. The charging roller 52 contacts the surface of the photoconductive drum 51. It is noted that the drum cartridge 5 may include a scorotron charging device instead of the charging roller 52.

1.4.3. Cleaning Roller 53

The cleaning roller 53 is capable of collecting paper dust from the surface of the photoconductive drum 51. The cleaning roller 53 contacts the surface of the photoconductive drum 51.

1.5. Developing Cartridge 6

As illustrated in FIG. 2, the developing cartridge 6 mounted on the drawer 4 is removable from the drawer 4 in the state in which the drawer 4 is located at the intermediate position. The state in which the developing cartridge 6 is mounted on the drawer 4 is a state in which the developing cartridge 6 is placed on a particular position of the drawer 4. The developing cartridge 6 may not be fixed to the drawer 4 in the state in which the developing cartridge 6 is mounted on the drawer 4. The developing cartridge 6 is mountable on the drawer 4 in the state in which the drawer 4 is located at the intermediate position.

As illustrated in FIG. 1, the developing cartridge 6 is not mountable on the drawer 4 in the state in which the drawer 4 is located at the inside position. The developing cartridge 6 mounted on the drawer 4 is not removable from the drawer 4 in the state in which the drawer 4 is located at the inside position. The developing cartridge 6 is located side by side with the photoconductive drum 51 in the first direction in a state in which the drum cartridge 5 and the developing cartridge 6 are mountable on the drawer 4. Specifically, the developing cartridge 6 is located on an opposite side of the axis A1 of the photoconductive drum 51 from the transfer roller 8 in the first direction in the state in which the drum cartridge 5 and the developing cartridge 6 are mountable on the drawer 4. In other words, the axis A1 of the photoconductive drum 51 is located between the transfer roller 8 and the developing cartridge 6 in the first direction in the state in which the drum cartridge 5 and the developing cartridge 6 are mounted on the drawer 4.

The developing cartridge 6 includes a developing roller 61. The developing roller 61 is rotatable about an axis A2. The axis A2 extends in the second direction. The developing roller 61 contacts the photoconductive drum 51. The developing roller 61 is capable of supplying toner stored in the developing cartridge 6, to the photoconductive drum 51.

1.6. Exposing Device 7

The exposing device 7 is capable of exposing the surface of the photoconductive drum 51 in the state in which the drum cartridge 5 and the developing cartridge 6 are mounted on the drawer 4, and the drawer 4 is located at the inside position. Specifically, the exposing device 7 is a laser scan unit.

When the surface of the photoconductive drum 51 is exposed by the exposing device 7 in a state in which the surface of the photoconductive drum 51 is charged by the charging roller 52, a latent image is formed on the surface of the photoconductive drum 51. When the toner is supplied to the surface of the photoconductive drum 51 by the developing roller 61 in the state in which the latent image is formed on the surface of the photoconductive drum 51, a toner image is formed on the surface of the photoconductive drum 51.

1.7. Transfer Roller 8

The transfer roller 8 is in contact with the photoconductive drum 51 in the state in which the drum cartridge 5 is mounted on the drawer 4, and the drawer 4 is located at the inside position. The sheet S conveyed by the conveying roller 34 passes through a position between the transfer roller 8 and the photoconductive drum 51. In this conveyance, the transfer roller 8 transfers the toner image formed on the surface of the photoconductive drum 51, to the sheet S.

1.8. Fixing Device 9

The fixing device 9 fixes the toner image to the sheet S by heating and pressurizing the sheet S to which the toner image has been transferred. The sheet S having passed through the fixing device 9 is discharged onto an upper surface of the housing 2.

2. Details of Housing 2

There will be next described the housing 2 in detail with reference to FIGS. 2-4B.

As illustrated in FIG. 2, the housing 2 includes the stopper 25 in addition to the cover 22, the drawer guide 23, and the drawer support 24. In other words, the image forming apparatus 1 includes the stopper 25.

2.1. Stopper 25

The stopper 25 stops the drawer 4 moving from the inside position toward the outside position, at the intermediate position. It is noted that the stopper 25 may be located at any position and may have any shape and configuration as long as the stopper 25 can stop the drawer 4 moving from the inside position toward the outside position, at the intermediate position. The stopper 25 is located in the housing 2. The stopper 25 is mounted on the drawer guide 23.

Figure 4A:
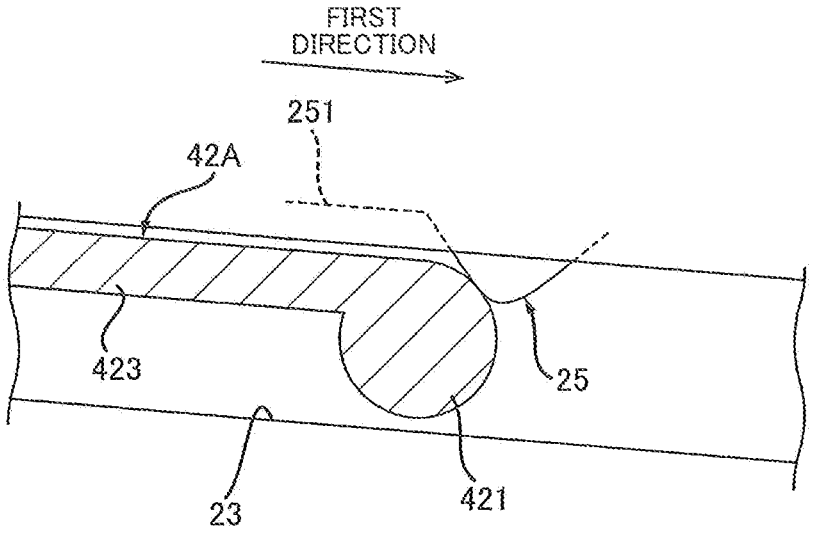
FIG. 4A is an enlarged view of a stopper illustrated in FIG. 2, illustrating a state in which the stopper is located at a first position.
Figure 4B:
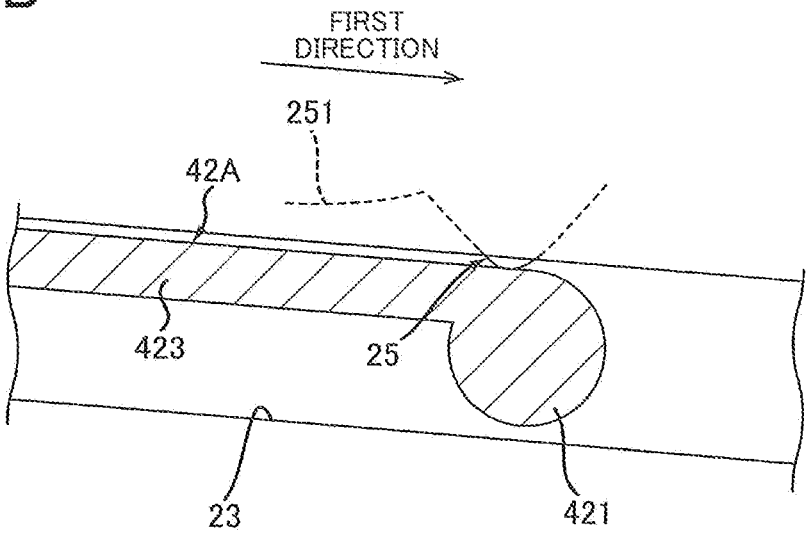
FIG. 4B is an enlarged view of the stopper, illustrating a state in which the stopper is located at a second position.

As illustrated in FIGS. 4A and 4B, the stopper 25 is movable between a first position (see FIG. 4A) and a second position (see FIG. 4B). The stopper 25 includes a spring 251. The stopper 25 is movable from the first position to the second position against a force of the spring 251. The stopper 25 is movable from the second position to the first position by the force of the spring 251.

As illustrated in FIG. 4A, when the drawer 4 is moved from the inside position to the outside position in a state in which the stopper 25 is located at the first position, the stopper 25 contacts the first guided portion 421 of the drawer 4 in the first direction. When the stopper 25 contacts the first guided portion 421 in the first direction, as illustrated in FIG. 2, the drawer 4 is stopped at the intermediate position. In other words, the stopper 25 contacts the first guided portion 421 of the drawer 4 located at the intermediate position, in the first direction in the state in which the stopper 25 is located at the first position, thereby stopping the drawer 4 from moving from the intermediate position to the outside position.

When the drawer 4 is pulled toward the outside position in the state in which the drawer 4 is stopped at the intermediate position by the stopper 25, as illustrated in FIG. 4B, the stopper 25 is pressed by the first guided portion 421 to move from the first position to the second position against the force of the spring 251.

The stopper 25 is not in contact with the first guided portion 421 in the first direction in the state in which the stopper 25 is located at the second position. Since the stopper 25 is not in contact with the first guided portion 421 in the first direction, the drawer 4 is not stopped at the intermediate position and moves from the intermediate position (see FIG. 2) to the outside position (see FIG. 3). In other words, when the stopper 25 is located at the second position, the stopper 25 allows the drawer 4 to move from the intermediate position to the outside position.

3. Details of Drawer 4

There will be next described the drawer 4 in detail with reference to FIGS. 5-9B.

Figure 5:
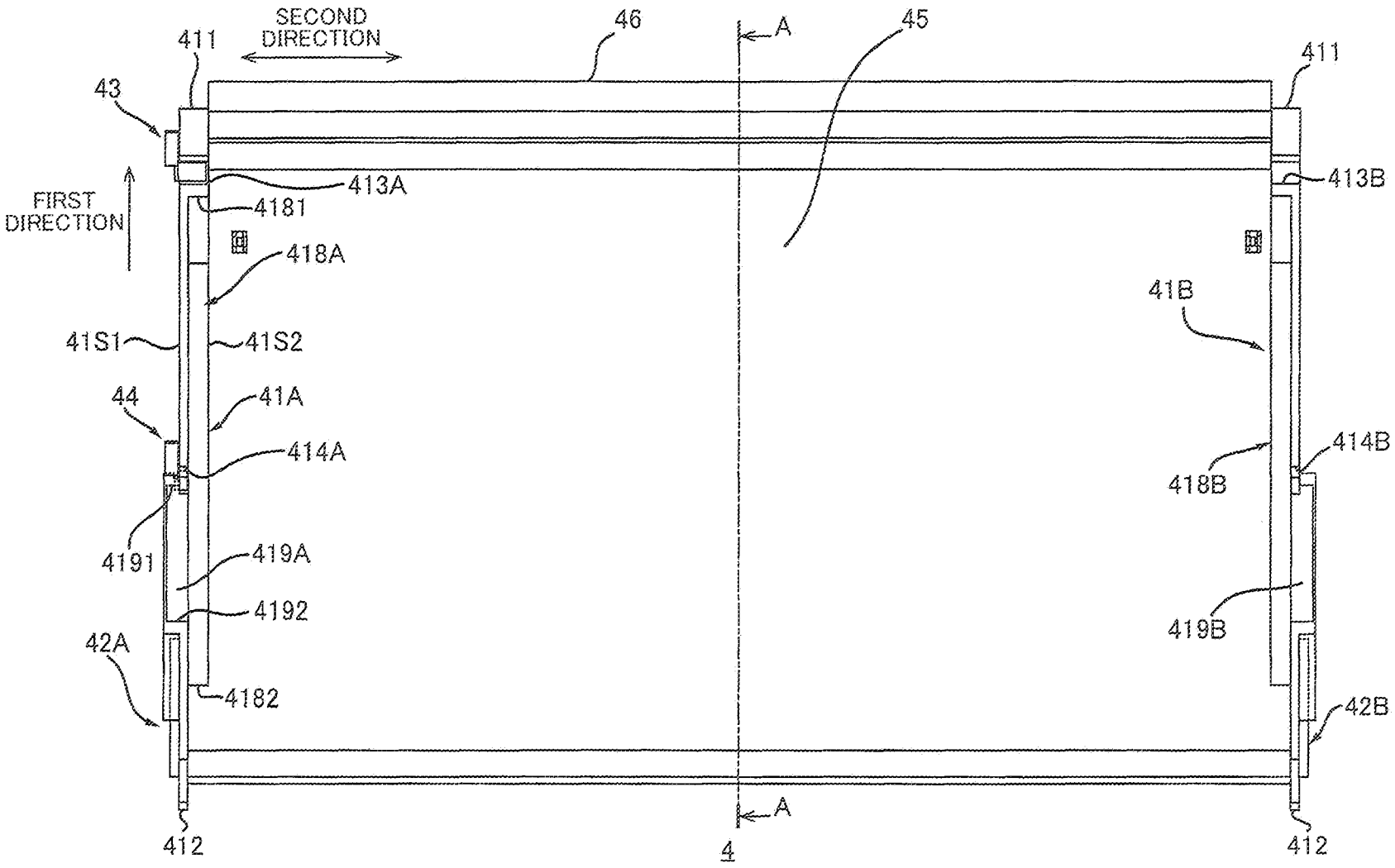
FIG. 5 is a plan view of the drawer illustrated in FIG. 1.

As illustrated in FIG. 5, the drawer 4 has a tray shape. The drawer 4 extends in the first direction and the second direction. The drawer 4 includes a side plate 41A, a side plate 41B, a first lock lever 43, a second lock lever 44, a guided portion 42A, a guided portion 42B, the bottom plate 45, and a drawer grip 46.

3.1. Side Plate 41A

The drawer 4 includes a first end portion and a second end portion in the second direction. The first end portion is located apart from the second end portion in the second direction. The side plate 41A is located at the first end portion of the drawer 4 in the second direction. The side plate 41A extends in the first direction. The side plate 41A includes a first end portion 411 and a second end portion 412 in the first direction. The first end portion 411 is located apart from the second end portion 412 in the first direction. The side plate 41A includes a first surface 41S1 and a second surface 41S2 in the second direction. The second surface 41S2 is located between the first surface 41S1 and the side plate 41B in the second direction.

Figure 6:
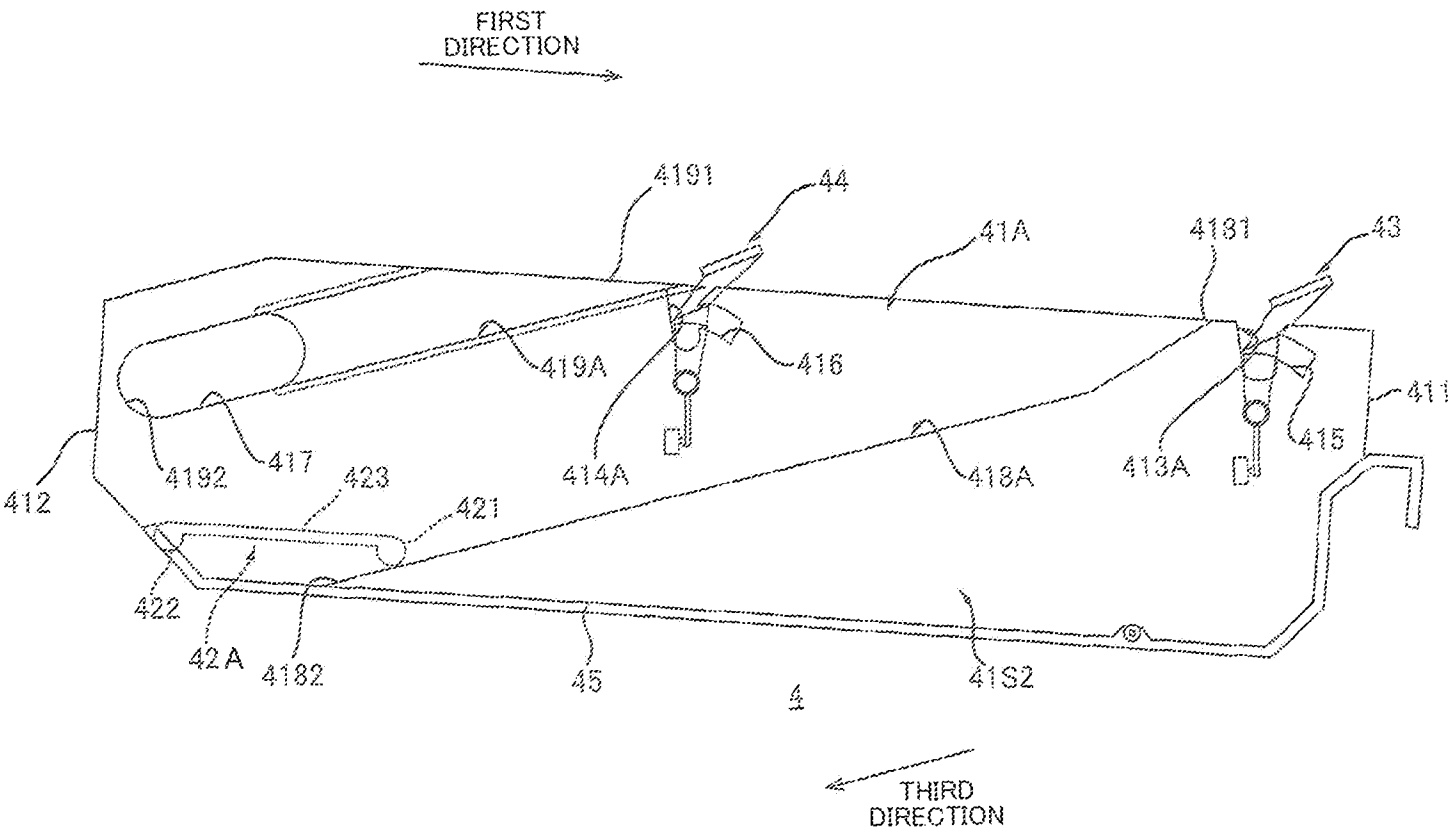
FIG. 6 is a cross-sectional view of the drawer illustrated in FIG. 5, taken along line A-A.

As illustrated in FIG. 6, the side plate 41A includes a first drum guide 418A, a second drum guide 419A, a first lock portion 413A, a second lock portion 414A, a first groove 415, a second groove 416, and a hole 417. In other words, the drawer 4 includes the first lock portion 413A and the second lock portion 414A.

3.1.1. First Drum Guide 418A

The first drum guide 418A guides the drum cartridge 5 when the drum cartridge 5 is mounted on the drawer 4. The first drum guide 418A is in contact with a drum-cartridge side plate 54A in the state in which the drum cartridge 5 is mounted on the drawer 4. The first drum guide 418A guides the drum-cartridge side plate 54A when the drum cartridge 5 is mounted on the drawer 4. The drum-cartridge side plate 54A will be described later.

The first drum guide 418A is provided on the second surface 41S2 of the side plate 41A. The first drum guide 418A is inclined with respect to the first direction so as to be nearer to the bottom plate 45 at a portion of the first drum guide 418A near the second end portion 412 of the side plate 41A than at a portion of the first drum guide 418A far from the second end portion 412 of the side plate 41A. The first drum guide 418A extends in a third direction. The third direction intersects the first direction and the second direction. The third direction preferably intersects the first direction and is orthogonal to the second direction. More specifically, the third direction is directed slantly downward toward the housing 2 in the state in which the drawer 4 is located at the outside position (see FIG. 3).

The first drum guide 418A includes a first end portion 4181 and a second end portion 4182 in the third direction. The second end portion 4182 is located apart from the first end portion 4181 in the third direction. The second end portion 4182 is located between the second end portion 412 of the side plate 41A and the first end portion 4181 in the first direction.

3.1.2 Second Drum Guide 419A

The second drum guide 419A guides the drum cartridge 5 with the first drum guide 418A when the drum cartridge 5 is mounted on the drawer 4. The second drum guide 419A is in contact with a guided portion 55A of the drum cartridge 5 in the state in which the drum cartridge 5 is mounted on the drawer 4. When the drum cartridge 5 is mounted on the drawer 4, the second drum guide 419A guides the guided portion 55A. The guided portion 55A will be described later.

The second drum guide 419A is provided on the second surface 41S2 of the side plate 41A. The second drum guide 419A is a groove. The second drum guide 419A is located between the second end portion 412 of the side plate 41A and the first drum guide 418A in the first direction. The second drum guide 419A is inclined so as to be nearer to the bottom plate 45 at a portion of the second drum guide 419A near the second end portion 412 than at a portion of the second drum guide 419A far from the second end portion 412. The second drum guide 419A extends in the third direction. The second drum guide 419A includes a first end portion 4191 and a second end portion 4192 in the third direction. The second end portion 4192 is located apart from the first end portion 4191 in the third direction. The second end portion 4192 is located between the second end portion 412 of the side plate 41A and the first end portion 4191 in the first direction.

3.1.3. First Lock Portion 413A

Figure 8:
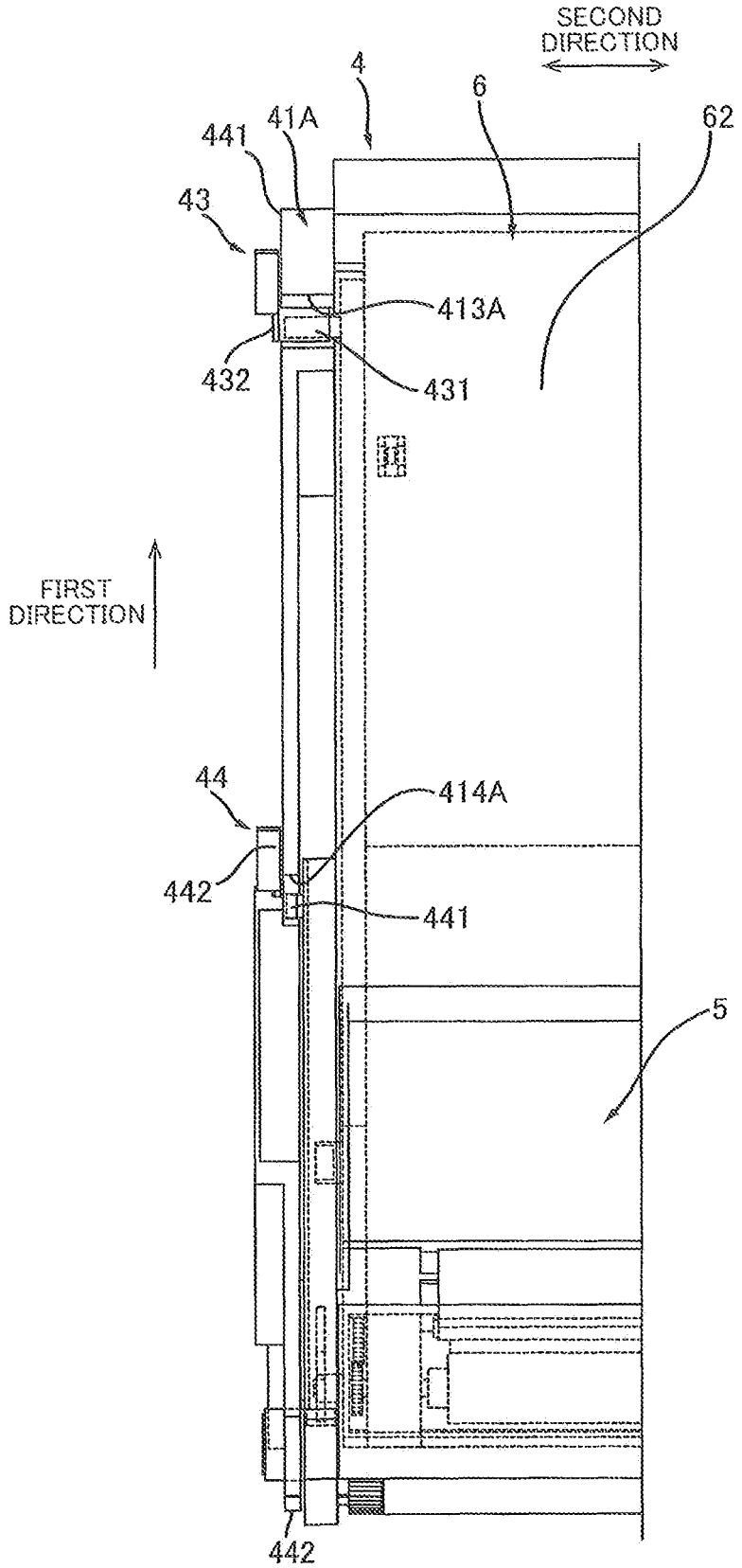
FIG. 8 is a plan view illustrating a state in which the developing cartridge is mounted on the drawer illustrated in FIG. 5, enlarging the first lock lever and a second lock lever.

The developing cartridge 6 is locked to the first lock portion 413A in the state in which the developing cartridge 6 is mounted on the drawer 4 (see FIG. 8). The first lock portion 413A is provided on an edge of the side plate 41A. The first lock portion 413A is located between the first end portion 4181 of the first drum guide 418A and the first end portion 411 of the side plate 41A in the first direction. The first lock portion 413A is a groove. The first lock portion 413A extends in the up and down direction.

3.1.4. Second Lock Portion 414A

The drum cartridge 5 is locked to the second lock portion 414A in the state in which the drum cartridge 5 is mounted on the drawer 4 (see FIG. 8). The second lock portion 414A is provided on an edge of the side plate 41A. The second lock portion 414A is located between the first end portion 4191 of the second drum guide 419A and the first end portion 4181 of the first drum guide 418A in the first direction. The second lock portion 414A is a groove. The second lock portion 414A extends in the up and down direction.

3.1.5. First Groove 415

The first groove 415 continues to the first lock portion 413A. The first groove 415 is located between the first lock portion 413A and the first end portion 411 of the side plate 41A in the first direction. The inner space of the first groove 415 communicates with the inner space of the first lock portion 413A.

3.1.6. Second Groove 416

The second groove 416 continues to the second lock portion 414A. The second groove 416 is located between the second lock portion 414A and the first drum guide 418A in the first direction. The inner space of the second groove 416 communicates with the inner space of the second lock portion 414A.

3.1.7. Hole 417

The hole 417 faces a flange 512A of the drum cartridge 5 in the state in which the drum cartridge 5 is mounted on the drawer 4. The flange 512A will be described later. The hole 417 communicates with the second end portion 4192 of the second drum guide 419A.

3.2. Side Plate 41B

As illustrated in FIG. 5, the side plate 41B is located at the second end portion of the drawer 4 in the second direction. The side plate 41B is located apart from the side plate 41A in the second direction. The side plate 41B includes a first drum guide 418B, a second drum guide 419B, a first lock portion 413B, and a second lock portion 414B. Explanation of the side plate 41B is similar to that of the side plate 41A.

3.3. Bottom Plate 45

The bottom plate 45 is located between the side plate 41A and the side plate 41B in the second direction. The bottom plate 45 extends in the second direction. The bottom plate 45 includes a first end portion and a second end portion in the second direction. The first end portion of the bottom plate 45 is connected to the side plate 41A. The second end portion of the bottom plate 45 is connected to the side plate 41B.

3.4. First Lock Lever 43

Figure 7A:
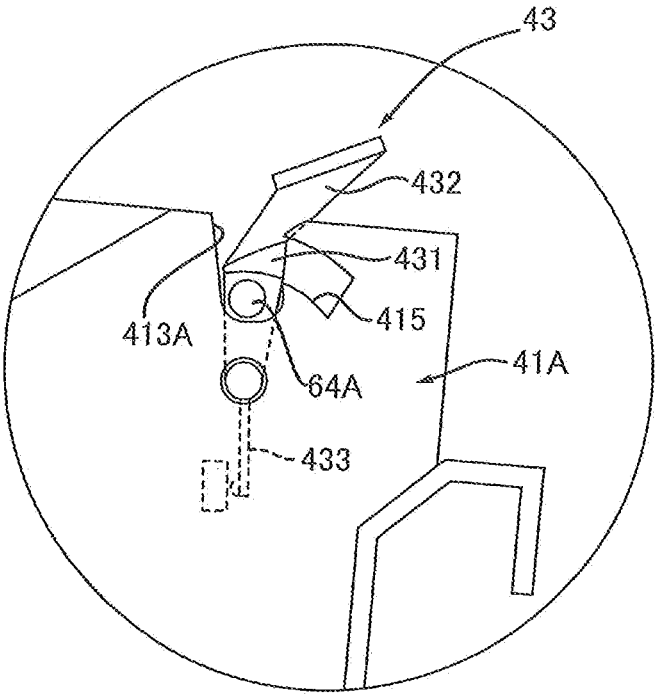
FIG. 7A is an enlarged view of a first lock lever illustrated in FIG. 6, illustrating a state in which the first lock lever is located at a lock position.
Figure 7B:
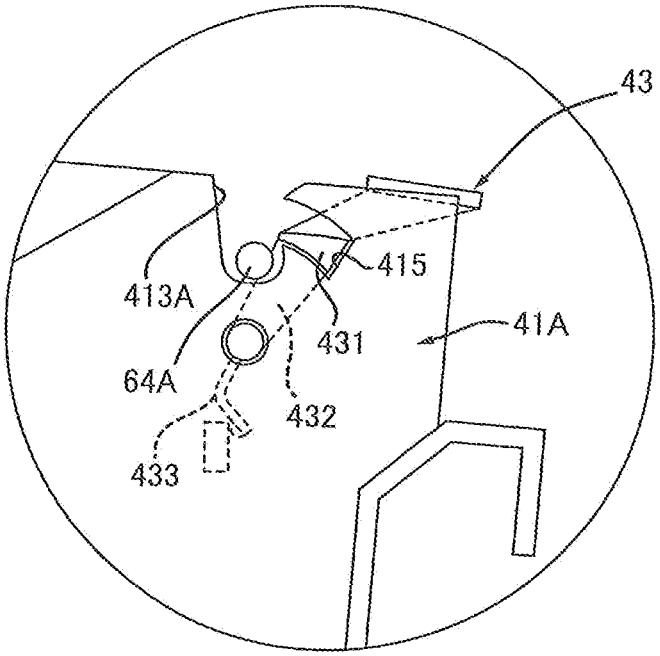
FIG. 7B is an enlarged view of the first lock lever, illustrating a state in which the first lock lever is located at a lock release position.

As illustrated in FIGS. 7A and 7B, the first lock lever 43 is mounted on the side plate 41A. The first lock lever 43 is movable between a lock position (see FIG. 7A) and a lock release position (see FIG. 7B). The first lock lever 43 locks the developing cartridge 6 (see FIG. 8) to the first lock portion 413A in the state in which the first lock lever 43 is located at the lock position. The lock of the developing cartridge 6 (see FIG. 8) to the first lock portion 413A is released in the state in which the first lock lever 43 is located at the lock release position.

As illustrated in FIG. 8, the first lock lever 43 includes a first lever body 432 and a first protrusion 431. The first lever body 432 of the first lock lever 43 is located on an opposite side of the side plate 41A from a development housing 62 of the developing cartridge 6 in the second direction in the state in which the developing cartridge 6 is mounted on the drawer 4. The development housing 62 will be described later. The first lever body 432 is located on an opposite side of the side plate 41A from the side plate 41B (see FIG. 5) in the second direction.

As illustrated in FIG. 7A, the first lever body 432 is rotatably supported by the side plate 41A. The first protrusion 431 extends from the first lever body 432 in the first direction. When the first lock lever 43 is located at the lock position, the first protrusion 431 is located in the first lock portion 413A. In the case where a user attempts to remove the developing cartridge 6 from the drawer 4 in the state in which the first lock lever 43 is located at the lock position, a development lock pin 64A contacts the first protrusion 431. Thus, the developing cartridge 6 is not removable from the drawer 4 in the state in which the first lock lever 43 is located at the lock position. The development lock pin 64A will be described later.

As illustrated in FIG. 7B, the first protrusion 431 is located in the first groove 415 and not located in the first lock portion 413A in the state in which the first lock lever 43 is located at the lock release position. This allows the user to remove the developing cartridge 6 from the drawer 4 in the state in which the first lock lever 43 is located at the lock release position.

The first lock lever 43 is movable from the lock release position to the lock position by a force of a spring 433. The first lock lever 43 is movable from the lock position to the lock release position against the force of the spring 433. The drawer 4 includes the spring 433.

As illustrated in FIG. 2, the first lock lever 43 is located outside the housing 2 in the state in which the developing cartridge 6 is mounted on the drawer 4, and the drawer 4 is located at the intermediate position. In other words, as illustrated in FIG. 2, in the state in which the developing cartridge 6 is mounted on the drawer 4, and the drawer 4 is located at the intermediate position, the first lock lever 43 is located outside the housing 2, that is, the first lock lever 43 is located on an onter side of the position of the cover 22 when the cover 22 is located at the closed position. This configuration allows the user to easily operate the first lock lever 43 in the state in which the drawer 4 is located at the intermediate position.

3.5. Second Lock Lever 44

Figure 9A:
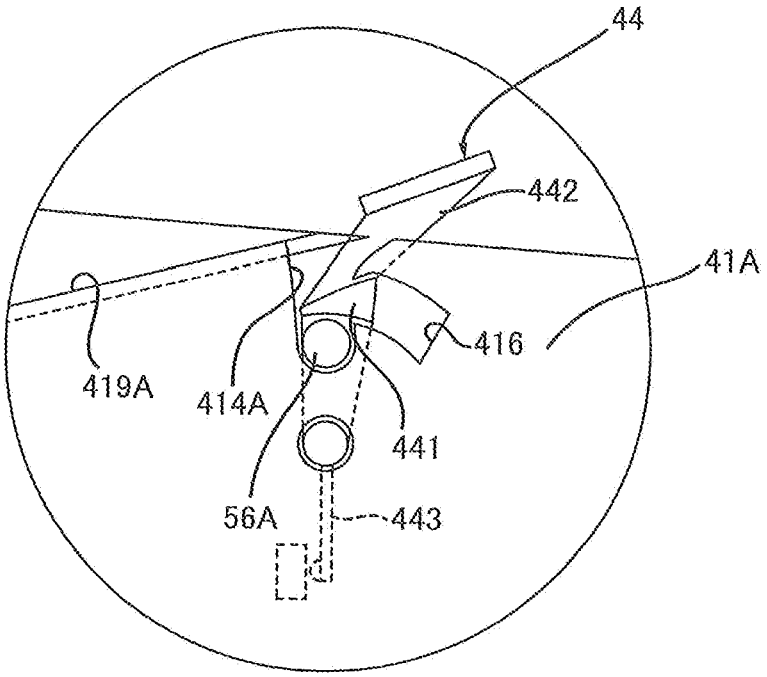
FIG. 9A is an enlarged view of the second lock lever illustrated in FIG. 6, illustrating a state in which the second lock lever is located at a lock position.
Figure 9B:
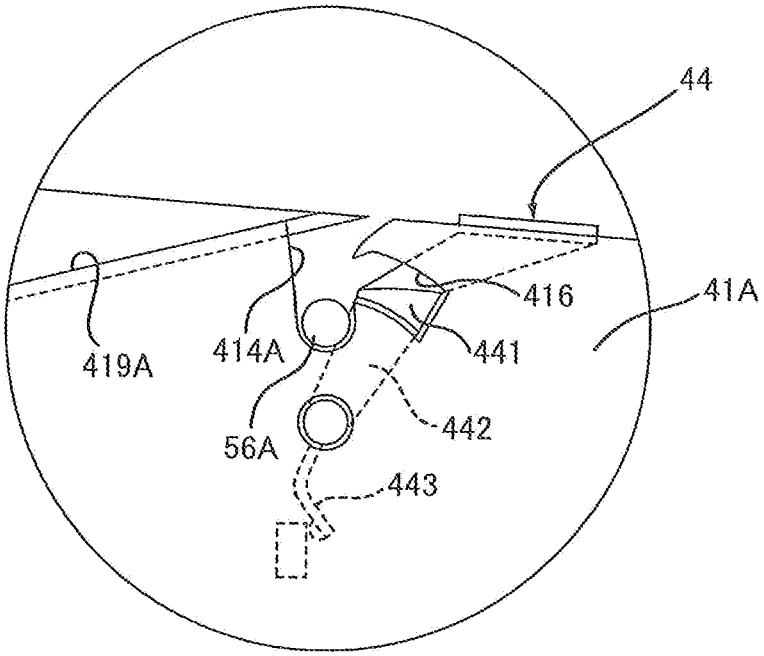
FIG. 9B is an enlarged view of the second lock lever, illustrating a state in which the second lock lever is located at a lock release position.

As illustrated in FIGS. 9A and 9B, the second lock lever 44 is mounted on the side plate 41A. The second lock lever 44 is movable between a lock position (see FIG. 9A) and a lock release position (see FIG. 9B). The second lock lever 44 locks the drum cartridge 5 (see FIG. 8) to the second lock portion 414A in the state in which the second lock lever 44 is located at the lock position. The second lock lever 44 releases the lock of the drum cartridge 5 (see FIG. 8) to the second lock portion 414A in the state in which the second lock lever 44 is located at the lock release position.

As illustrated in FIG. 8, the second lock lever 44 includes a second lever body 442 and a second protrusion 441. In the state in which the drum cartridge 5 is mounted on the drawer 4, the second lever body 442 of the second lock lever 44 is located on an opposite side of the side plate 41A from the drum cartridge 5 in the second direction. The second lever body 442 is located on an opposite side of the side plate 41A from the side plate 41B (see FIG. 5) in the second direction.

As illustrated in FIG. 9A, the second lever body 442 is rotatably supported by the side plate 41A. The second protrusion 441 extends from the second lever body 442 in the first direction. When the second lock lever 44 is located at the lock position, the second protrusion 441 is located in the second lock portion 414A. In the case where the user attempts to remove the drum cartridge 5 from the drawer 4 in the state in which the second lock lever 44 is located at the lock position, a drum lock pin 56A contacts the second protrusion 441. Thus, the drum cartridge 5 is not removable from the drawer 4 in the state in which the second lock lever 44 is located at the lock position. The drum lock pin 56A will be described later.

In the state in which the second lock lever 44 is located at the lock release position, as illustrated in FIG. 9B, the second protrusion 441 is located in the second groove 416 and not located in the second lock portion 414A. This allows the user to remove the drum cartridge 5 from the drawer 4 in the state in which the second lock lever 44 is located at the lock release position.

The second lock lever 44 is movable from the lock release position to the lock position by a force of a spring 443. The second lock lever 44 is movable from the lock position to the lock release position against the force of the spring 443. The drawer 4 includes the spring 443.

As illustrated in FIG. 2, the second lock lever 44 is located in the housing 2 in the state in which the drum cartridge 5 is mounted on the drawer 4, and the drawer 4 is located at the intermediate position. In other words, as illustrated in FIG. 2, in the state in which the drum cartridge 5 is mounted on the drawer 4, and the drawer 4 is located at the intermediate position, the second lock lever 44 is located inside the housing 2, that is, the second lock lever 44 is located on an inner side of the position of the cover 22 when the cover 22 is located at the closed position. This configuration prevents the user from erroneously operating the second lock lever 44 in the state in which the drawer 4 is located at the intermediate position.

As illustrated in FIG. 3, the second lock lever 44 is located outside the housing 2 in the state in which the drum cartridge 5 is mounted on the drawer 4, and the drawer 4 is located at the outside position. This configuration allows the user to easily operate the second lock lever 44 in the state in which the drawer 4 is located at the outside position.

3.6. Guided Portion 42A

As illustrated in FIG. 5, the guided portion 42A is located on an opposite side of the side plate 41A from the side plate 41B in the second direction. The guided portion 42A is located on the first surface 41S1 of the side plate 41A. The guided portion 42A is located between the second end portion 412 of the side plate 41A and the second lock lever 44 in the first direction. The guided portion 42A protrudes from the first surface 41S1 in the second direction. The guided portion 42A extends in the first direction. The guided portion 42A may be mounted on the first surface 41S1. The guided portion 42A is fitted to the drawer guide 23 (see FIG. 1) of the housing 2. The guided portion 42A is guided by the drawer guide 23.

As illustrated in FIG. 6, the guided portion 42A includes the first guided portion 421, the second guided portion 422, and a coupling plate 423. The first guided portion 421 is located apart from the second guided portion 422 in the first direction. The first guided portion 421 is located on an opposite side of the second guided portion 422 from the second end portion 412 of the side plate 41A in the first direction. The first guided portion 421 has a circular cylindrical shape. The second guided portion 422 has a circular cylindrical shape. The coupling plate 423 is located between the first guided portion 421 and the second guided portion 422. The coupling plate 423 extends in the first direction. The coupling plate 423 includes a first end portion and a second end portion in the first direction. The first end portion of the coupling plate 423 is connected to the first guided portion 421. The second end portion of the coupling plate 423 is connected to the second guided portion 422.

3.7. Guided Portion 42B

As illustrated in FIG. 5, the guided portion 42B is located on an opposite side of the side plate 41B from the side plate 41A in the second direction. Explanation of the guided portion 42B is similar to that of the guided portion 42A.

3.8. Drawer Grip 46

The user holds the drawer grip 46 when moving the drawer 4 between the inside position and the outside position. The drawer grip 46 is located at an end portion of the drawer 4 in the first direction. The drawer grip 46 extends in the second direction. The drawer grip 46 includes a first end portion and a second end portion in the second direction. The first end portion of the drawer grip 46 is connected to the first end portion 411 of the side plate 41A. The second end portion of the drawer grip 46 is connected to the first end portion 411 of the side plate 41B.

4. Details of Drum Cartridge 5

Figure 10:
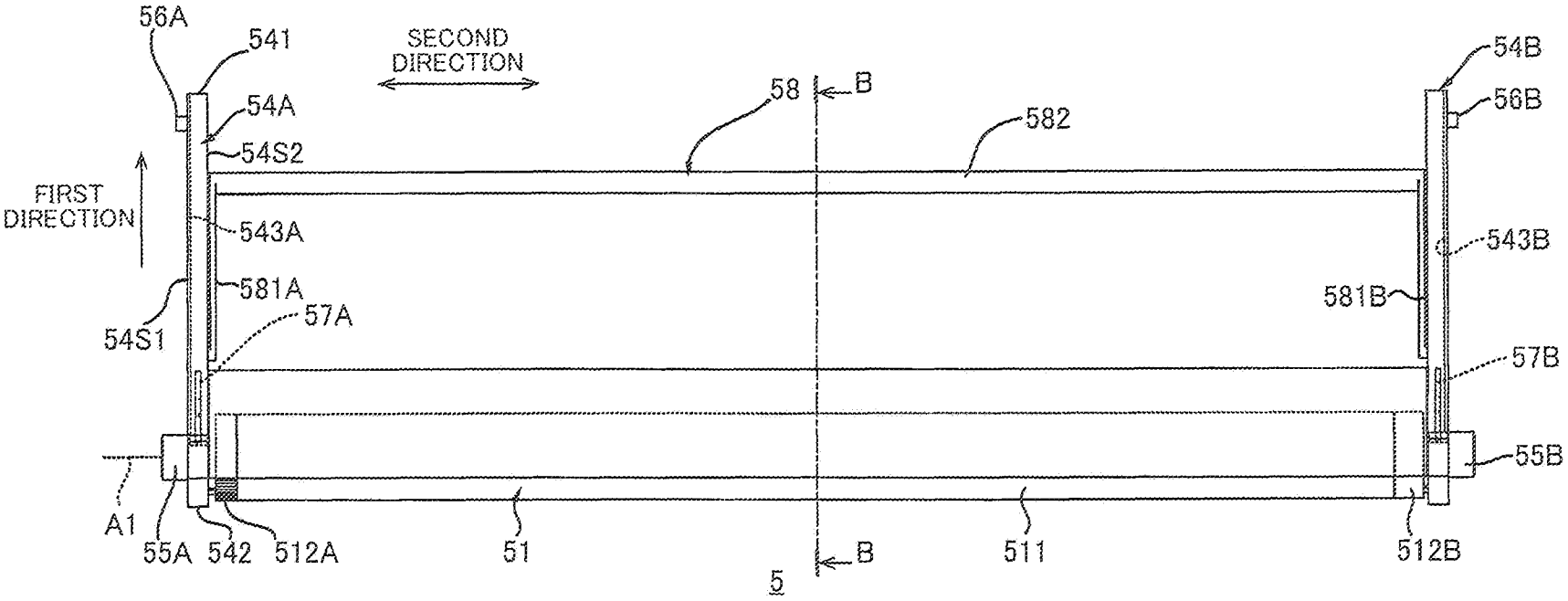
FIG. 10 is a plan view of the drum cartridge illustrated in FIG. 1.
Figure 11A:
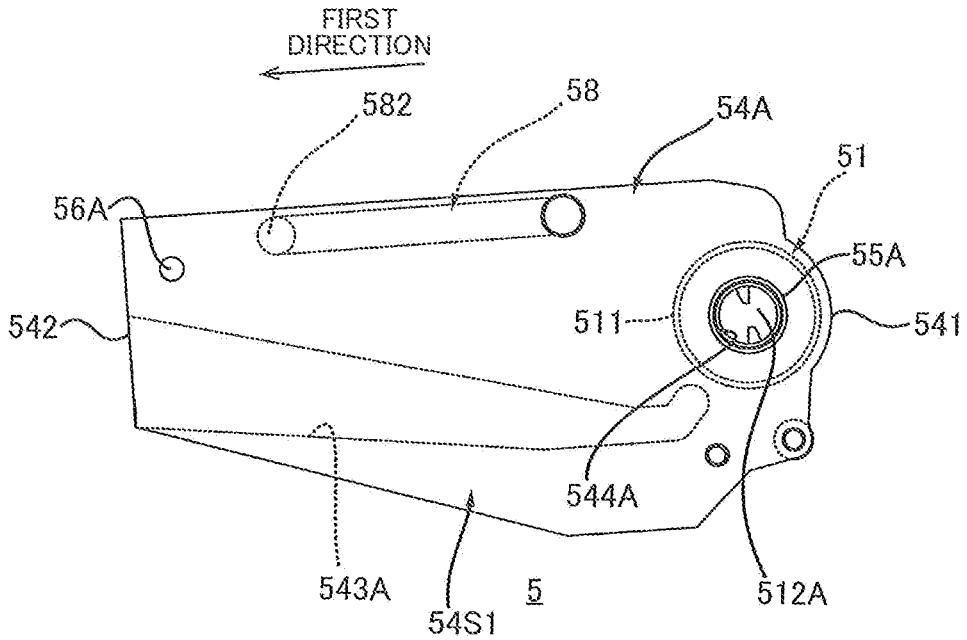
FIG. 11A is a side view of the drum cartridge illustrated in FIG. 10.
Figure 11B:
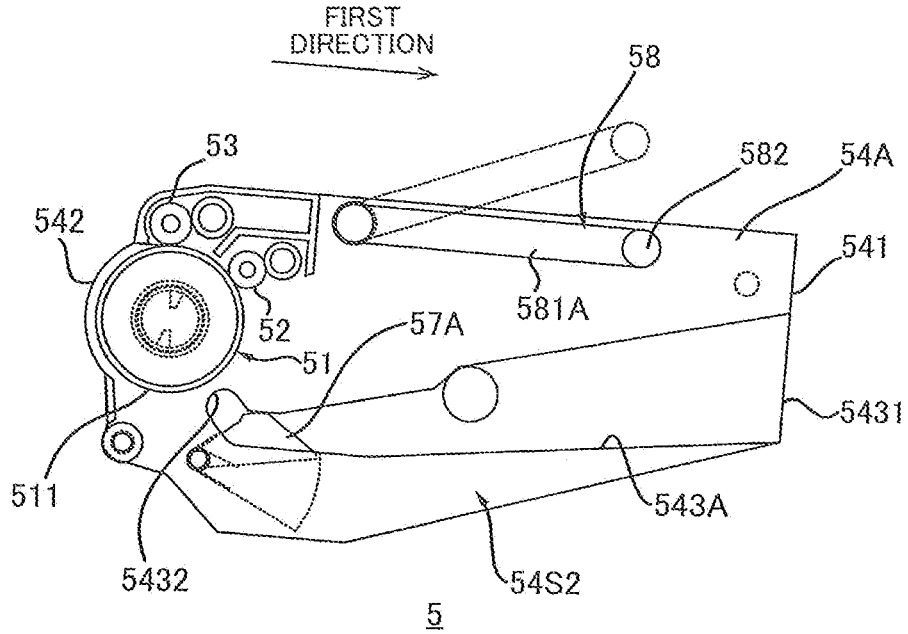
FIG. 11B is a cross-sectional view of the drum cartridge illustrated in FIG. 10, taken along line B-B.

There will be next described the drum cartridge 5 in detail with reference to FIGS. 10-11B.

As illustrated in FIG. 10, the drum cartridge 5 extends in the second direction. In addition to the photoconductive drum 51, the charging roller 52 (see FIG. 11B), and the cleaning roller 53 (see FIG. 11B), the drum cartridge 5 includes the drum-cartridge side plate 54A, a drum-cartridge side plate 54B, the guided portion 55A, a guided portion 55B, a pressing member 57A, a pressing member 57B, the drum lock pin 56A, a drum lock pin 56B, and a handle 58.

4.1. Drum-Cartridge Side Plate 54A

The drum cartridge 5 includes a first end portion and a second end portion in the second direction. The first end portion is located apart from the second end portion in the second direction. The drum-cartridge side plate 54A is located at the first end portion of the drum cartridge 5 in the second direction. The drum-cartridge side plate 54A extends in a direction intersecting the axis A1. The drum-cartridge side plate 54A preferably extends in a direction orthogonal to the axis A1. The drum-cartridge side plate 54A extends in the first direction. The drum-cartridge side plate 54A includes a first end portion 541 and a second end portion 542 in the first direction. The first end portion 541 is located apart from the second end portion 542 in the first direction. The drum-cartridge side plate 54A includes a first surface 54S1 and a second surface 54S2 in the second direction. The second surface 54S2 is located between the first surface 54S1 and the drum-cartridge side plate 54B in the second direction. As illustrated in FIGS. 11A and 11B, the drum-cartridge side plate 54A includes a hole 544A and a development guide 543A.

4.1.1. Hole 544A

As illustrated in FIG. 11A, an end portion of the photoconductive drum 51 is fitted to the hole 544A.

Specifically, the photoconductive drum 51 includes a drum body 511, the flange 512A, and a flange 512B (see FIG. 10). The drum body 511 extends in the second direction. The drum body 511 has a cylindrical shape. The drum body 511 includes a first end portion and a second end portion in the second direction. The first end portion is located apart from the second end portion in the second direction. The flange 512A is located at the first end portion of the drum body 511. The flange 512A is mounted on the first end portion of the drum body 511. The flange 512A extends in the second direction. The flange 512A has a cylindrical shape. The flange 512A is fitted in the hole 544A. The flange 512B is located at the second end portion of the drum body 511 (see FIG. 10). Explanation of the flange 512B is similar to that of the flange 512A.

4.1.2. Development Guide 543A

As illustrated in FIG. 11B, when the developing cartridge 6 is mounted on the drawer 4 in the state in which the drum cartridge 5 is mounted on the drawer 4, the development guide 543A guides the developing cartridge 6. A guided portion 63A of the developing cartridge 6 is fitted to the development guide 543A. When the developing cartridge 6 is mounted on the drawer 4 in the state in which the drum cartridge 5 is mounted on the drawer 4, the development guide 543A guides the guided portion 63A. The guided portion 63A will be described later.

The development guide 543A is provided on the second surface 54S2 of the drum-cartridge side plate 54A. The development guide 543A is a groove. The development guide 543A includes a first end portion 5431 and a second end portion 5432. The first end portion 5431 is located apart from the second end portion 5432 in the first direction. The first end portion 5431 is located at the first end portion 541 of the drum-cartridge side plate 54A. The second end portion 5432 is nearer to the photoconductive drum 51 than the first end portion 5431.

4.2. Drum-Cartridge Side Plate 54B

As illustrated in FIG. 10, the drum-cartridge side plate 54B is located apart from the drum-cartridge side plate 54A in the second direction. The drum-cartridge side plate 54B is located at the second end portion of the drawer 4 in the second direction. The drum-cartridge side plate 54B includes a development guide 543B. Explanation of the drum-cartridge side plate 54B is similar to that of the drum-cartridge side plate 54A.

4.3. Pressing Member 57A

As illustrated in FIG. 11B, the pressing member 57A presses the developing roller 61 toward the photoconductive drum 51 (see FIG. 1). The pressing member 57A is provided on the development guide 543A. The pressing member 57A is movable between the first position and the second position. The pressing member 57A is located in the development guide 543A in a state in which the pressing member 57A is located at the first position. The pressing member 57A presses the guided portion 63A fitted to the second end portion 5432, toward the photoconductive drum 51 (see FIG. 2). The pressing member 57A is not located in the development guide 543A in a state in which the pressing member 57A is located at the second position. In the state in which the pressing member 57A is located at the second position, the pressing member 57A allows the guided portion 63A to move from the first end portion 5431 to the second end portion 5432.

4.4. Pressing Member 57B

As illustrated in FIG. 10, the pressing member 57B is provided on the development guide 543B. Explanation of the pressing member 57B is similar to that of the pressing member 57A.

4.5. Guided Portion 55A

The guided portion 55A is located on an opposite side of the drum-cartridge side plate 54A from the drum-cartridge side plate 54B in the second direction. The guided portion 55A is located on the first surface 54S1 of the drum-cartridge side plate 54A. The guided portion 55A extends from the first surface 54S1. The guided portion 55A may be mounted on the first surface 54S1. The guided portion 55A extends in the second direction. The guided portion 55A extends along the axis A1. The guided portion 55A has a cylindrical shape.

As illustrated in FIG. 11A, the end portion of the photoconductive drum 51 in the second direction is fitted to the guided portion 55A. The flange 512A of the photoconductive drum 51 is fitted to the guided portion 55A. It is noted that the guided portion 55A may be the end portion of the photoconductive drum 51 in the second direction. The guided portion 55A may be the flange 512A of the photoconductive drum 51. The end portion of the photoconductive drum 51 in the second direction may not be fitted to the guided portion 55A.

When the drum cartridge 5 is mounted on the drawer 4, the guided portion 55A is guided by the second drum guide 419A (see FIG. 6) of the drawer 4. The guided portion 55A faces the hole 417 (see FIG. 6) of the drawer 4 in the state in which the drum cartridge 5 is mounted on the drawer 4.

4.6. Guided Portion 55B

As illustrated in FIG. 10, the guided portion 55B is located on an opposite side of the drum-cartridge side plate 54B from the drum-cartridge side plate 54A in the second direction. Explanation of the guided portion 55B is similar to that of the guided portion 55A.

4.7. Drum Lock Pin 56A

The drum lock pin 56A is located on an opposite side of the drum-cartridge side plate 54A from the drum-cartridge side plate 54B in the second direction. The drum lock pin 56A is located apart from the guided portion 55A in the first direction. The drum lock pin 56A is located on the first surface 54S1 of the drum-cartridge side plate 54A. The drum lock pin 56A is a protrusion. The drum lock pin 56A extends from the first surface 54S1. The drum lock pin 56A may be mounted on the first surface 54S1. The drum lock pin 56A extends in the second direction. The drum lock pin 56A has a circular cylindrical shape. The drum lock pin 56A is fitted to the second lock portion 414A in the state in which the drum cartridge 5 is mounted on the drawer 4 (see FIG. 9A).

4.8. Drum Lock Pin 56B

As illustrated in FIG. 10, the drum lock pin 56B is located on an opposite side of the drum-cartridge side plate 54B from the drum-cartridge side plate 54A in the second direction. Explanation of the drum lock pin 56B is similar to that of the drum lock pin 56A.

4.9. Handle 58

The user holds the handle 58 when replacing the drum cartridge 5. As illustrated in FIG. 10, the handle 58 is located between the drum-cartridge side plate 54A and the drum-cartridge side plate 54B in the second direction. The handle 58 includes an arm 581A, an arm 581B, and a drum grip 582. In other words, the drum cartridge 5 includes the drum grip 582.

The arm 581A is mounted on the drum-cartridge side plate 54A. The arm 581A is pivotably supported by the drum-cartridge side plate 54A. The arm 581B is located apart from the arm 581A in the second direction. The arm 581B is mounted on the drum-cartridge side plate 54B. The arm 581B is pivotably supported by the drum-cartridge side plate 54B.

The drum grip 582 is located between the arm 581A and the arm 581B in the second direction. The drum grip 582 extends in the second direction. The drum grip 582 includes a first end portion and a second end portion in the second direction. The first end portion of the drum grip 582 is connected to the arm 581A. The second end portion of the drum grip 582 is connected to the arm 581B.

As illustrated in FIG. 2, the drum grip 582 is located in the housing 2 in the state in which the drum cartridge 5 is mounted on the drawer 4, and the drawer 4 is located at the intermediate position. This configuration prevents the user from erroneously holding the drum grip 582 in the state in which the drawer 4 is located at the intermediate position.

As illustrated in FIG. 3, the drum grip 582 is located outside the housing 2 in the state in which the drum cartridge 5 is mounted on the drawer 4, and the drawer 4 is located at the outside position. This configuration allows the user to easily hold the drum grip 582 in the state in which the drawer 4 is located at the outside position. This allows the user to smoothly remove the drum cartridge 5 from the drawer 4.

5. Details of Developing Cartridge 6

Figure 12:
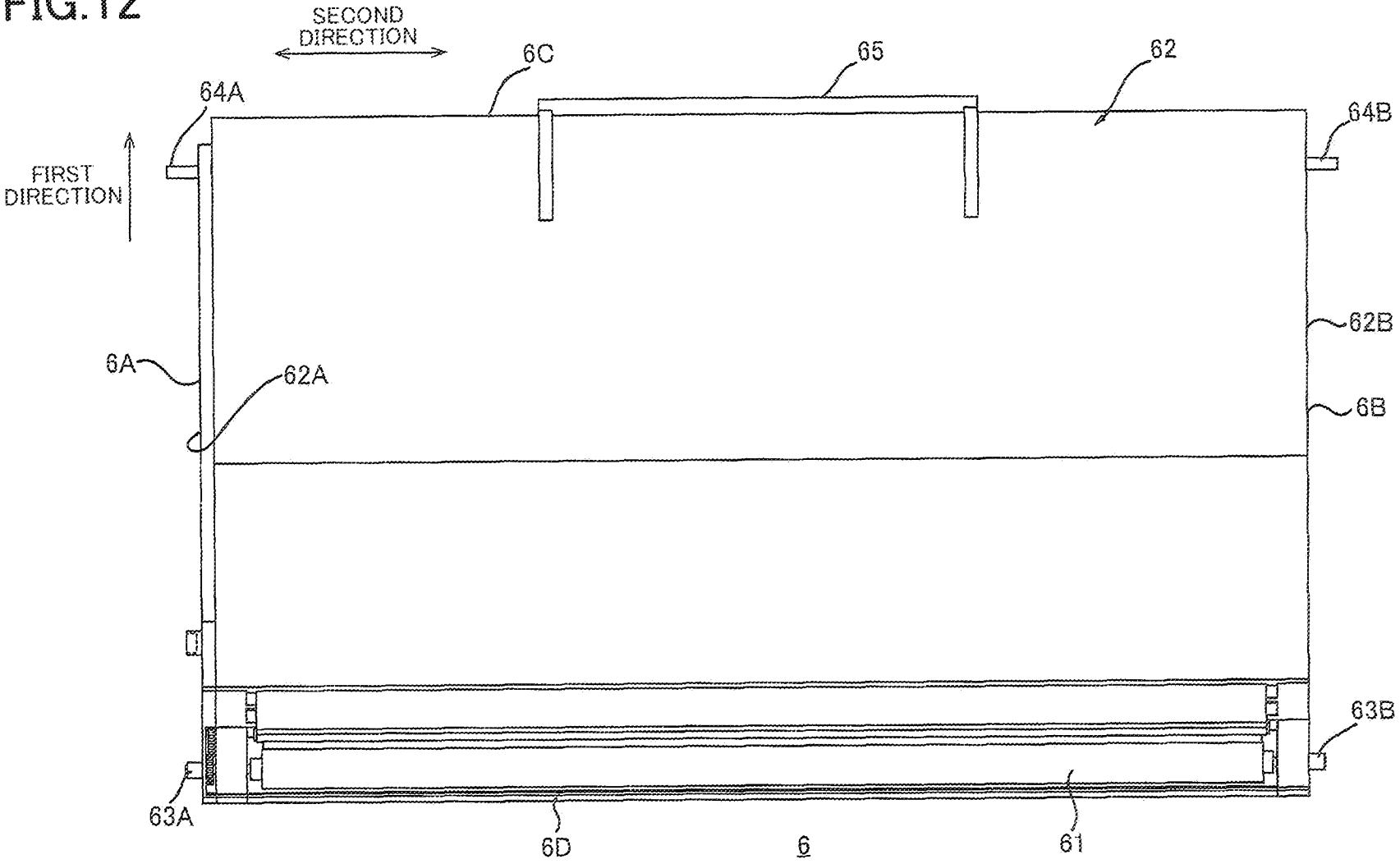
FIG. 12 is a plan view of the developing cartridge illustrated in FIG. 1.

There will be next described the developing cartridge 6 in detail with reference to FIG. 12.

As illustrated in FIG. 12, the developing cartridge 6 extends in the second direction. The developing cartridge 6 includes a first end portion 6A and a second end portion 6B in the second direction. The first end portion 6A is located apart from the second end portion 6B in the second direction. The developing cartridge 6 extends in the first direction. The developing cartridge 6 includes a first end portion 6C and a second end portion 6D in the first direction. The first end portion 6C is located apart from the second end portion 6D in the first direction. The developing roller 61 is located at the second end portion 6D of the developing cartridge 6. In addition to the developing roller 61, the developing cartridge 6 includes the development housing 62, the guided portion 63A, a guided portion 63B, the development lock pin 64A, a development lock pin 64B, and a development grip 65.

5.1. Development Housing 62

The development housing 62 houses the developing roller 61. The development housing 62 contains toner. The development housing 62 includes a side surface 62A and a side surface 62B in the second direction. The side surface 62A is located at the first end portion 6A of the developing cartridge 6. The side surface 62B is located at the second end portion 6B of the developing cartridge 6. The development housing 62 is located between the side plate 41A and the side plate 41B (see FIG. 8) in the state in which the developing cartridge 6 is mounted on the drawer 4.

5.2. Guided Portion 63A

The guided portion 63A is located at the first end portion 6A of the developing cartridge 6 in the second direction. The guided portion 63A is a protrusion. The guided portion 63A extends from the side surface 62A of the development housing 62. The guided portion 63A may be mounted on the development housing 62. The guided portion 63A extends in the second direction. The guided portion 63A has a cylindrical shape. When the developing cartridge 6 is mounted on the drawer 4, the guided portion 63A is guided by the development guide 543A (see FIG. 11B).

5.3. Guided Portion 63B

The guided portion 63B is located at the second end portion 6B of the developing cartridge 6 in the second direction. The guided portion 63B extends from the side surface 62B of the development housing 62. Explanation of the guided portion 63B is similar to that of the guided portion 63A.

5.4. Development Lock Pin 64A

The development lock pin 64A is located at the first end portion 6A of the developing cartridge 6 in the second direction. The development lock pin 64A is located apart from the guided portion 63A in the first direction. The development lock pin 64A is a protrusion. The development lock pin 64A extends from the side surface 62A of the development housing 62. The development lock pin 64A may be mounted on the development housing 62. The development lock pin 64A extends in the second direction. The development lock pin 64A has a circular cylindrical shape. The development lock pin 64A is fitted to the first lock portion 413A (see FIG. 7A) in the state in which the developing cartridge 6 is mounted on the drawer 4.

5.5. Development Lock Pin 64B

The development lock pin 64B is located at the second end portion 6B of the developing cartridge 6 in the second direction. The development lock pin 64B extends from the side surface 62B of the development housing 62. Explanation of the guided portion 63B is similar to that of the guided portion 63A.

5.6. Development Grip 65

The development grip 65 is located at the first end portion 6C of the developing cartridge 6 in the first direction. The development grip 65 is held by the user.

As illustrated in FIG. 2, the development grip 65 is located outside the housing 2 in the state in which the developing cartridge 6 is mounted on the drawer 4, and the drawer 4 is located at the intermediate position. This configuration allows the user to easily hold the development grip 65 in the state in which the drawer 4 is located at the intermediate position. This allows the user to smoothly remove the developing cartridge 6 from the drawer 4 in the state in which the drum cartridge 5 is mounted on the drawer 4.

6. Replacement of Developing Cartridge 6

There will be next described replacement of the developing cartridge 6 with reference to FIGS. 2, 7A, 7B, and 11B.

6.1. Removal of Developing Cartridge 6

To remove the developing cartridge 6, as illustrated in FIG. 2, the user first positions the cover 22 to the open position and moves the drawer 4 on which the drum cartridge 5 and the developing cartridge 6 are mounted, to the intermediate position.

Then, as illustrated in FIGS. 7A and 7B, the user moves the first lock lever 43 from the lock position to the lock release position. As a result, the developing cartridge 6 becomes removable from the drawer 4.

Then, as illustrated in FIG. 2, the user holds the development grip 65 and pulls the developing cartridge 6 out of the drawer 4 to remove the developing cartridge 6 from the drawer 4.

6.2. Mounting of Developing Cartridge 6

To mount the developing cartridge 6, the user first fits the guided portion 63A to the first end portion 5431 of the development guide 543A in the state in which the drum cartridge 5 is mounted on the drawer 4, and the drawer 4 is located at the intermediate position.

The user then slides the developing cartridge 6 toward the inside of the housing 2. In this operation, the guided portion 63A is guided by the development guide 543A, so that the guided portion 63A reaches the second end portion 5432 of the development guide 543A.

In response, the development lock pin 64A falls into the first lock portion 413A (see FIG. 7A) and contacts the first protrusion 431 (see FIG. 7A). The development lock pin 64A then pushes the first protrusion 431 to move the first lock lever 43 from the lock position to the lock release position. As a result, the development lock pin 64A passes through a position between the first protrusion 431 and an inner surface of the first lock portion 413A and is fitted to the first lock portion 413A. The force of the spring 433 (see FIG. 7B) moves the first lock lever 43 from the lock release position to the lock position.

As a result, mounting of the developing cartridge 6 to the drawer 4 is completed.

7. Replacement of Drum Cartridge 5

There will be next described replacement of the drum cartridge 5 with reference to FIGS. 3, 9A, and 9B.

7.1. Removal of Drum Cartridge 5

To remove the drum cartridge 5, as illustrated in FIG. 3, the user moves the drawer 4 on which the drum cartridge 5 is mounted, from the intermediate position (see FIG. 2) to the outside position.

Then, as illustrated in FIGS. 9A and 9B, the user moves the second lock lever 44 from the lock position to the lock release position. As a result, the drum cartridge 5 becomes removable from the drawer 4.

Then, as illustrated in FIG. 3, the user holds the drum grip 582 and pulls the drum cartridge 5 out of the drawer 4 to remove the drum cartridge 5 from the drawer 4.

7.2. Mounting of Drum Cartridge 5

To mount the drum cartridge 5, the user puts the drum-cartridge side plate 54A on the first drum guide 418A and fits the guided portion 55A of the drum cartridge 5 to the first end portion 4191 of the second drum guide 419A in the state in which the drawer 4 is located at the outside position.

The user then slides the drum cartridge 5 toward the inside of the housing 2.

In response, the drum-cartridge side plate 54A is guided by the first drum guide 418A, and the guided portion 55A is guided by the second drum guide 419A. The guided portion 55A reaches the second end portion 4192 of the second drum guide 419A.

In this operation, the drum lock pin 56A falls into the second lock portion 414A (see FIG. 9A) and contacts the second protrusion 441 (see FIG. 9A). The drum lock pin 56A then pushes the second protrusion 441 to move the second lock lever 44 from the lock position to the lock release position. As a result, the drum lock pin 56A passes through a position between the second protrusion 441 and an inner surface of the second lock portion 414A and is fitted to the second lock portion 414A. The force of the spring 443 (see FIG. 9B) moves the second lock lever 44 from the lock release position to the lock position.

As a result, mounting of the drum cartridge 5 to the drawer 4 is completed.

8. Effects (1) As illustrated in FIG. 1, the image forming apparatus 1 includes the drawer 4, the drum cartridge 5, and the developing cartridge 6. The drum cartridge 5 includes the photoconductive drum 51 and is mountable on the drawer 4. The developing cartridge 6 includes the developing roller 61 and is mountable on the drawer 4.

Thus, as illustrated in FIGS. 2 and 3, in the image forming apparatus 1 including the drawer 4, the drum cartridge 5 including the photoconductive drum 51 and the developing cartridge 6 including the developing roller 61 can be replaced individually.

This allows the user to replace the drum cartridge 5 and the developing cartridge 6 individually at appropriate timings in accordance with their respective useful lifes.

In the image forming apparatus 1, as illustrated in FIG. 2, the developing cartridge 6 can be replaced in the state in which the drawer 4 is stopped at the intermediate position.

This can reduce a distance by which the drawer 4 is pulled, when compared with the case where the user replaces the developing cartridge 6 by pulling out the drawer 4 to the outside position.

This prevents the image forming apparatus 1 from being out of balance during operation of replacing the developing cartridge 6.

(2) In the image forming apparatus 1, as illustrated in FIG. 2, the drawer guide 23 is inclined such that the first end portion 231 is lower than the second end portion 232.

Thus, the drawer 4 moves such that its position is lower at the outside position than at the inside position.

This configuration enables the drawer 4 to be easily moved from the inside position to the outside position using the weight of the drawer 4.

(3) In the image forming apparatus 1, as illustrated in FIG. 2, the development grip 65 is located outside the housing 2 in the state in which the developing cartridge 6 is mounted on the drawer 4, and the drawer 4 is located at the intermediate position.

This configuration allows the user to easily hold the development grip 65 in the state in which the drawer 4 is located at the intermediate position.

This allows the user to smoothly remove the developing cartridge 6 from the drawer 4 in the state in which the drum cartridge 5 is mounted on the drawer 4.

(4) In the image forming apparatus 1, as illustrated in FIG. 2, the drum grip 582 is located in the housing 2 in the state in which the drum cartridge 5 is mounted on the drawer 4, and the drawer 4 is located at the intermediate position.

This configuration prevents the user from erroneously holding the drum grip 582 in the state in which the drawer 4 is located at the intermediate position.

As illustrated in FIG. 3, the drum grip 582 is located outside the housing 2 in the state in which the drum cartridge 5 is mounted on the drawer 4, and the drawer 4 is located at the outside position.

This configuration allows the user to easily hold the drum grip 582 in the state in which the drawer 4 is located at the outside position. This allows the user to smoothly remove the drum cartridge 5 from the drawer 4.

(5) In the image forming apparatus 1, as illustrated in FIG. 7A, the development lock pin 64A of the developing cartridge 6 is locked to the first lock portion 413A by the first lock lever 43 in the state in which the developing cartridge 6 is mounted on the drawer 4.

This configuration prevents separation of the developing cartridge 6 from the drawer 4 when moving the drawer 4 on which the developing cartridge 6 is mounted.

(6) In the image forming apparatus 1, as illustrated in FIG. 2, the first lock lever 43 is movable between the lock position and the lock release position. The first lock lever 43 is located outside the housing 2 in the state in which the drawer 4 is located at the intermediate position.

This configuration allows the user to easily operate the first lock lever 43 in the state in which the drawer 4 is located at the intermediate position.

(7) In the image forming apparatus 1, as illustrated in FIG. 9A, the drum lock pin 56A of the drum cartridge 5 is locked to the second lock portion 414A by the second lock lever 44 in the state in which the drum cartridge 5 is mounted on the drawer 4.

This configuration prevents separation of the drum cartridge 5 from the drawer 4 when moving the drawer 4 on which the drum cartridge 5 is mounted.

(8) In the image forming apparatus 1, as illustrated in FIG. 2, the second lock lever 44 is movable between the lock position and the lock release position. The second lock lever 44 is located in the housing 2 in the state in which the drawer 4 is located at the intermediate position.

This configuration prevents the user from erroneously operating the second lock lever 44 in the state in which the drawer 4 is located at the intermediate position.

As illustrated in FIG. 3, the second lock lever 44 is located outside the housing 2 in the state in which the drawer 4 is located at the outside position.

This configuration allows the user to easily operate the second lock lever 44 in the state in which the drawer 4 is located at the outside position.

What is claimed is:

1. An image forming apparatus comprising:

a housing;

a drawer movable in a first direction from an inside position at which the drawer is located inside the housing, to an outside position at which the drawer is located outside the housing;

a drum cartridge comprising a photoconductive drum and mounted on the drawer; and a developing cartridge comprising a developing roller and mounted on the drawer, wherein the drawer comprises;

a first lock portion to which the developing cartridge is locked in a state in which the developing cartridge is mounted on the drawer; and a first lock lever movable between (i) a lock position at which the first lock lever locks the developing cartridge to the first lock portion, and (ii) a lock release position at which lock of the developing cartridge to the first lock portion is released.

2. The image forming apparatus according to claim 1, further comprising a stopper movable between (i) a first position at which the stopper stops the drawer from moving from an intermediate position to the outside position, and (ii) a second position at which the stopper allows the drawer to move from the intermediate position to the outside position, the intermediate position being positioned between the inside position and the outside position in the first direction, wherein the first lock lever is located outside the housing in the state in which the drawer is located at the intermediate position.

3. The image forming apparatus according to claim 1, wherein the photoconductive drum is rotatable about an axis extending in a second direction intersecting the first direction, wherein the drawer comprises a side plate, wherein the first lock lever is mounted on the side plate, and wherein the first lock lever is located on an opposite side of the side plate from the developing cartridge in the second direction in the state in which the developing cartridge is mounted on the drawer.

4. The image forming apparatus according to claim 1, wherein the drawer comprises a second lock portion to which the drum cartridge is locked in a state in which the drum cartridge is mounted on the drawer.

5. The image forming apparatus according to claim 4, wherein the drawer comprises a second lock lever movable between (i) a lock position at which the second lock lever locks the drum cartridge to the second lock portion, and (ii) a lock release position at which lock of the drum cartridge to the second lock portion is released.

6. The image forming apparatus according to claim 5, further comprising a stopper movable between (i) a first position at which the stopper stops the drawer from moving from an intermediate position to the outside position, and (ii) a second position at which the stopper allows the drawer to move from the intermediate position to the outside position, the intermediate position being positioned between the inside position and the outside position in the first direction, wherein the second lock lever is located in the housing in a state in which the drum cartridge is mounted on the drawer, and the drawer is located at the intermediate position, and the second lock lever is located outside the housing in a state in which the drum cartridge is mounted on the drawer, and the drawer is located at the outside position.

7. The image forming apparatus according to claim 5, wherein the photoconductive drum is rotatable about an axis extending in a second direction intersecting the first direction, wherein the drawer comprises a side plate, wherein the second lock lever is mounted on the side plate, and wherein the second lock lever is located on an opposite side of the side plate from the drum cartridge in the second direction in the state in which the drum cartridge is mounted on the drawer.

8. The image forming apparatus according to claim 5, wherein the first lock lever is located outside the housing, and the second lock lever is located outside the housing in a state in which the drawer is located at the outside position.

9. The image forming apparatus according to claim 1, further comprising a transfer roller, wherein the photoconductive drum is located between the transfer roller and the developing cartridge in the first direction in a state in which the drum cartridge and the developing cartridge are mounted on the drawer.

10. The image forming apparatus according to claim 9, wherein the housing comprises a drawer guide configured to guide the drawer and extending in the first direction, wherein the drawer guide comprises a first end portion and a second end portion in the first direction, and the second end portion is located between the first end portion and the transfer roller in the first direction, and wherein the drawer guide is inclined such that the first end portion is lower than the second end portion.

11. The image forming apparatus according to claim 1, further comprising a stopper movable between (i) a first position at which the stopper stops the drawer from moving from an intermediate position to the outside position, and (ii) a second position at which the stopper allows the drawer to move from the intermediate position to the outside position, the intermediate position being positioned between the inside position and the outside position in the first direction, wherein the developing cartridge comprises a development grip, and wherein the development grip is located outside the housing in a state in which the developing cartridge is mounted on the drawer, and the drawer is located at the intermediate position.

12. The image forming apparatus according to claim 1, further comprising a stopper movable between (i) a first position at which the stopper stops the drawer from moving from an intermediate position to the outside position, and (ii) a second position at which the stopper allows the drawer to move from the intermediate position to the outside position, the intermediate position being positioned between the inside position and the outside position in the first direction, wherein the drum cartridge comprises a drum grip, and wherein the drum grip is located in the housing in a state in which the drum cartridge is mounted on the drawer, and the drawer is located at the intermediate position, and the drum grip is located outside the housing in a state in which the drum cartridge is mounted on the drawer, and the drawer is located at the outside position.

* * * * *